United States Patent [19]

Evans

[11] 4,107,486

[45] Aug. 15, 1978

[54] SWITCH OPERATING MECHANISMS FOR HIGH VOLTAGE SWITCHES

[75] Inventor: David M. Evans, Palatine, Ill.

[73] Assignee: S & C Electric Company, Chicago, Ill.

[21] Appl. No.: 701,064

[22] Filed: Jun. 30, 1976

[51] Int. Cl.[2] ..... H01H 31/00

[52] U.S. Cl. ..... 200/48 R; 335/68

[58] Field of Search ..... 335/68; 200/48 R

[56] References Cited

U.S. PATENT DOCUMENTS

| | | | |
|---|---|---|---|
| 3,286,211 | 11/1966 | Soos | 335/68 |
| 3,359,464 | 12/1967 | Henderson | 335/68 |
| 3,432,780 | 3/1969 | Evans et al. | 335/68 |
| 3,508,179 | 4/1970 | Bernatt et al. | 335/68 |
| 3,688,228 | 8/1972 | Palmer et al. | 335/68 |

*Primary Examiner*—Brooks H. Hunt
*Attorney, Agent, or Firm*—Kirkland & Ellis

[57] ABSTRACT

A three-phase, high voltage switch arrangement is operated through a connected drive shaft by a switch operating mechanism that can be either driven by motor power or manually operated. When manual operation is desired, a crank handle is folded out of a stored position to an operating position. An improved mechanism is provided to prevent the crank handle from operably engaging the switch operating mechanism until stored torsional energy (i.e., the potential energy due to torsional strain) in the drive shaft has been released thereby avoiding improper operation, such as unexpected whipping of the handle. In addition, when the crank handle is folded out to its operating position, the motor is disabled so that the motor can not be operated while the handle is engaged with the mechanism so that the handle cannot be driven by the motor. When it is desired to disconnect the switch operating mechanism from the switch so that maintenance and testing can be performed, a selector handle may be operated that disconnects the drive shaft from the operating mechanism and locks the drive shaft so that the switch cannot be accidentally opened or closed due to wind or vibrational forces. Also, while the selector handle is being operated, the motor cannot be operated while the drive shaft is being disconnected and locked.

12 Claims, 21 Drawing Figures

110
112
50
52
116
114
240
272
276
284
280
282
56
288
64
278
58

A
B
C
36
140
178
170
158
156
164
162
166
154
150
152
180
168
176
172
174
175
183
182
186
184
187
192
188
208
190
104
177
244
102
98
96
94
92
90
72
100
86
88
41
70
43
84
82
80
74
242
232
236
234
240

SWITCH OPERATING MECHANISMS FOR HIGH VOLTAGE SWITCHES

BACKGROUND OF THE INVENTION

1. Field of the Invention

The present invention relates to improvements to motor driven operators for high voltage switches, and more particularly, the present invention relates to means for preventing a manually operable crank handle from engaging a switch operating mechanism until stored energy has been released and means for disconnecting the drive shaft and locking the drive shaft of a switch operating mechanism when maintenance or testing is to be performed.

2. Description of the Prior Art

The present invention comprises improvements to the switch operating mechanism disclosed in U.S. Pat. No. 3,508,179 — Bernatt et al., issued Apr. 21, 1970. Motor driven operating mechanisms for high voltage switches are well known in the art. Such mechanisms are also disclosed in U.S. Pat. No. 3,432,780 — Evans et al., issued Mar. 11, 1969. Typically, such switch operating mechanisms are motor driven and controlled by remotely located control circuitry which causes automatic operation of the switch operating mechanism in response to appropriate control signals from the control circuitry. For example, the control circuitry may be designed to sense fault conditions in the electrical transmission system so that the high voltage switches are rapidly operated to open the high voltage circuit when a fault condition exists. However, although the high voltage switch is usually remotely controlled, it is desirable to also provide a means for manually operating the switch operator at a location adjacent the high voltage switches. Further, it is often desirable to disconnect the operating mechanism from the high voltage switches so that the mechanism can be tested and maintenance performed without the necessity of operating the high voltage switches and thereby interrupting the high voltage circuit.

Since the high voltage switches are typically interconnected by long drive and interphase shafts, and since the mechanism is ordinarily driven by a motor driving through a gear train having a substantial gear reduction so that substantial torgue is imparted to the system, the drive shaft and interphase shafts typically are placed under torsional stress when the switch is operated. A brake mechanism is usually provided which locks the motor immediately after power is removed so that the torsional energy remains stored in the system until released when the brake is released.

When manual operation is desired, a crank handle is typically connected to the mechanism and the brake is released so that the switches can be operated manually. However, when the brake is released, the torsional energy stored in the system is also released, sometimes causing a rapid whipping of the manually operable crank handle which may harm the operator. Accordingly, it would be a desirable advance in the art to provide a means for preventing engagement of the crank handle with the mechanism until the torsional energy has been released thereby avoiding possible unexpected whipping of the crank handle.

Further, since high voltage switches are typically mounted well above ground on towerlike supports, these switches experience externally applied forces resulting from wind and vibration. Accordingly, unless the drive shaft is locked, it is possible for the switches to inadvertently and accidentally move from a closed position to an opened position or vice versa when such movement is not desirable. Accordingly, it would be a desirable advance in the art to provide an improved means for locking the drive shaft whenever the drive shaft is disconnected from the operating mechanism so that maintenance and testing can be performed on the switch operating mechanism without the risk of the high voltage switches accidentally opening or closing.

BRIEF DESCRIPTION OF THE INVENTION

An improved operating mechanism for a high voltage switch in accordance with the present invention comprises a rotatably mounted drive shaft connected to a high voltage switch for causing the switch to open and close in response to rotation of the drive shaft. A coupling means is mounted for rotation with the drive shaft and the coupling means is also mounted for sliding movement along the drive shaft between a first and a second position. The coupling means also has a first engaging means associated therewith. A motor driven means is provided having a second engaging means associated therewith for engaging with the first engaging means when the coupling means is in its first position and for disengaging the first engaging means when the coupling means is in its second position. Also provided is means for locking the drive shaft to prevent rotation thereof when the coupling means is moved to its second position. Operably associated with the coupling means is a means for moving the coupling means between its first and second positions in response to manual selection.

A manually operable crank handle is also provided on the mechanism and is foldable from a stored position to an operating position. A piston means is operably connected with the crank handle for rotation therewith and for translational motion in response to the folding of the crank handle from a stored position to an operating position. The piston means includes engaging means associated therewith for engaging the gear train of the switch operator so that rotation of the crank handle will rotate the drive shaft to operate the switch. Also provided is means for preventing the engaging means from engaging the gear train until the crank handle has both been folded to the operating position and rotated through a partial revolution. Means are provided for releasing the motor brake while folding of the crank handle to the operating position so that torsional energy stored in the drive shaft is released when the brake is released before the engaging means engages the gear train.

Accordingly, it is a principal object of the present invention to provide an improved switch operating mechanism which allows release of stored torsional energy before a manually operable crank handle is engaged.

Yet another object of the present invention is to provide an improved switch operating mechanism which permits the drive shaft connected to the high voltage switch to be disconnected from the mechanism and locked in position to prevent accidental operation of the switch while maintenance or testing is being performed on the mechanism.

Yet another object of the present invention is to disable the electric motor of the switch operating mechanism while the crank handle is in engagement therewith.

Yet another object of the present invention is to provide an improved switch operating mechanism that disables the motor while the drive shaft is being disconnected and locked or while the drive shaft is being unlocked and reconnected.

These and other objects, advantages, and features of the present invention will hereinafter appear, and for the purposes of illustration, but not for limitation, an exemplary embodiment of the present invention is illustrated in accompanying drawings.

DESCRIPTION OF THE PREFERRED EMBODIMENT

Figure 1:
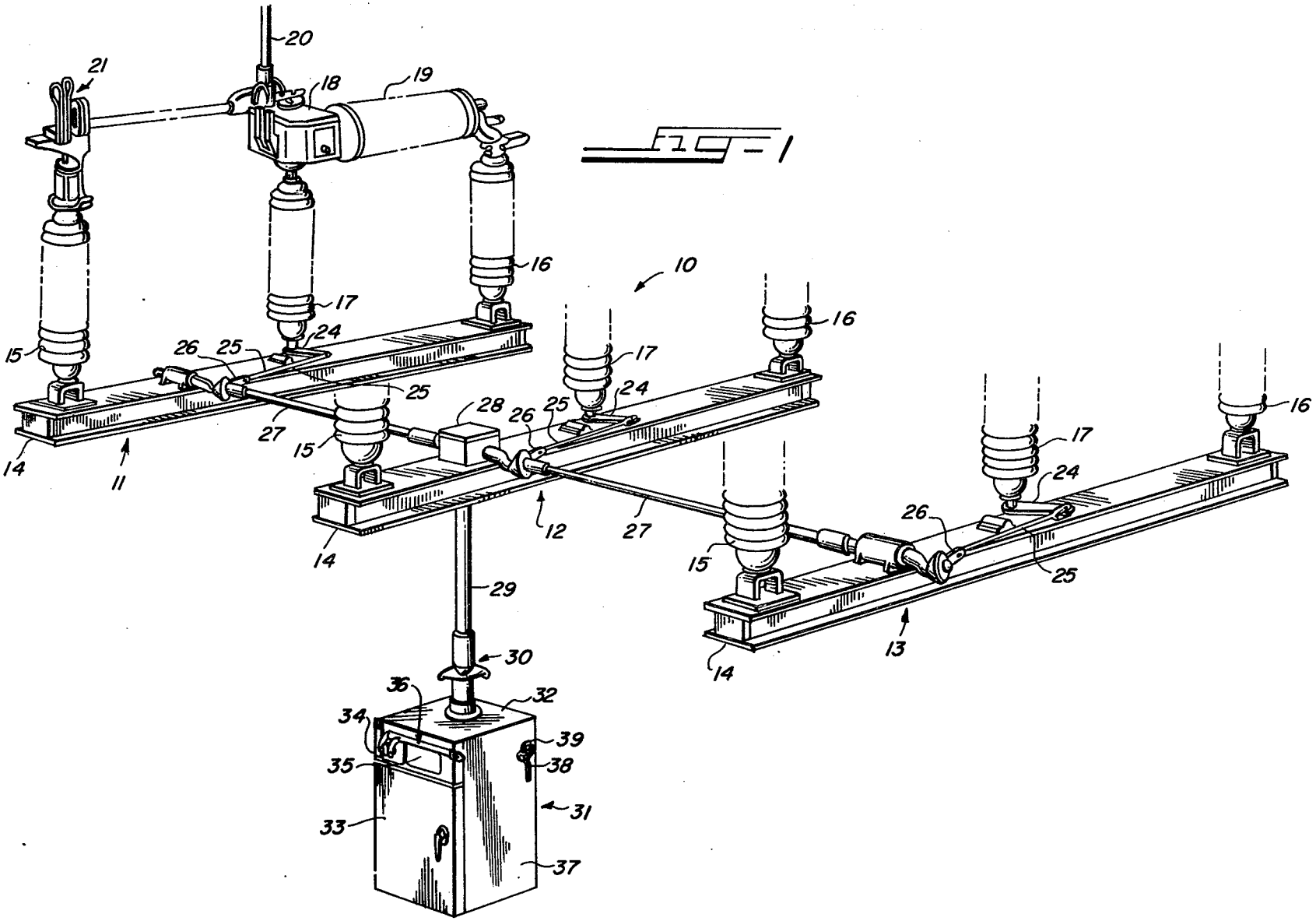
FIG. 1 is a upper perspective view of a three-phase high voltage switch arrangement having an improved switch operating mechanism in accordance with the present invention connected thereto.

With reference to FIG. 1, a perspective view of a three-pole or three-phase high voltage switch for connection in a power transmission system is illustrated. Only one of the switch poles is shown completely, and the insulators and base for each of the other poles is only partially shown. The three-pole, high voltage switch is indicated generally by numeral 10, and is suitable for use in conjunction with high voltage electrical alternating current power transmission lines. The high voltage switch can be constructed in the manner disclosed in U.S. Pat. No. 3,116,391 — Lindell et al., issued Dec. 30, 1963, or in accordance with other well known constructions. The individual switch poles are indicated by the numerals 11, 12 and 13. Each switch pole includes a base member 14 of suitable channel construction or the like having at its ends stationary insulators 15 and 16, and a rotatable insulator 17 mounted intermediate its ends. The insulator 17 is rotatable through an angle of approximately 100° for the purpose of moving an interrupter operating mechanism 18 at its upper end through its operating cycle. Between the stationary insulator 16 and the interruptor operating mechanism 18 there is positioned a load current interrupter 19 which is arranged to be opened to interrupt the circuit before the switch blade 20 is swung out of engagement with a switch contact assembly indicated generally by numeral 21 carried by stationary insulator 15.

For effecting simultaneous operation of the rotatable insulators 17, laterally extending arms 24 are connected by links 25 to arms 26 which extends from interphase shafts 27 which are suitably journalled on the base members 14. Interphase shafts 27 are driven through a gear box 28 by a vertically extending drive shaft 29 that is arranged to be rotated through an angle of approximately 180°. At its lower end, the drive shaft 29 is connected by a shaft coupling and bearing assembly 30 to a switch operating mechanism 31. Switch operation mechanism 31 is enclosed in a weatherproof housing 32. An access door 33 is provided for the housing 32 which can be locked against unauthorized entry. Above the access door 33 is a front cover 34 in which is provided a window 35 to permit inspection of a portion of the interior of housing 32 and particularly the portions of the operating mechanism therein. A manually operable crank handle assembly 36 is arranged to be folded over front cover 34 and to be folded out to an operating position so that it can be rotated to operate the switch operating mechanism in a manner to be hereinafter described. The housing 32 includes a side wall 37 on which a selector handle 38 is located supported by a selector handle mount 39 mounted on side wall 37.

Figure 4:
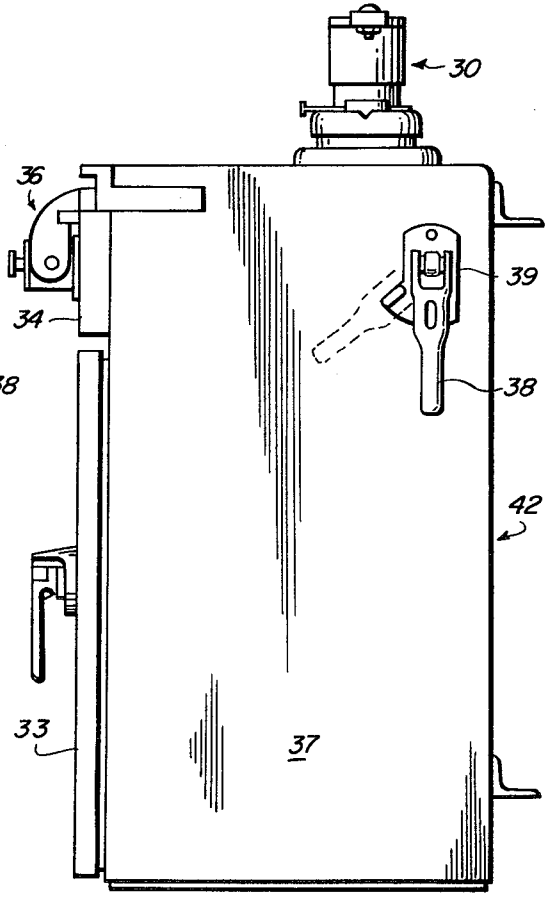
FIG. 4 is a right side plane view of the improved switch operating mechanism illustrated in FIG. 2.
Figure 3:
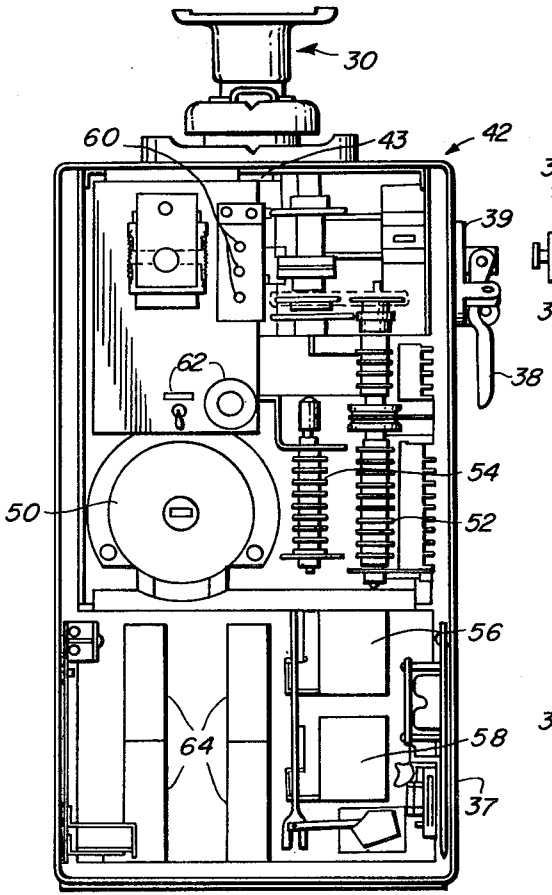
FIG. 3 is a front plane view of the improved switch operating mechanism illustrated in FIG. 2 having the front removed therefrom to expose the internal components.
Figure 2:
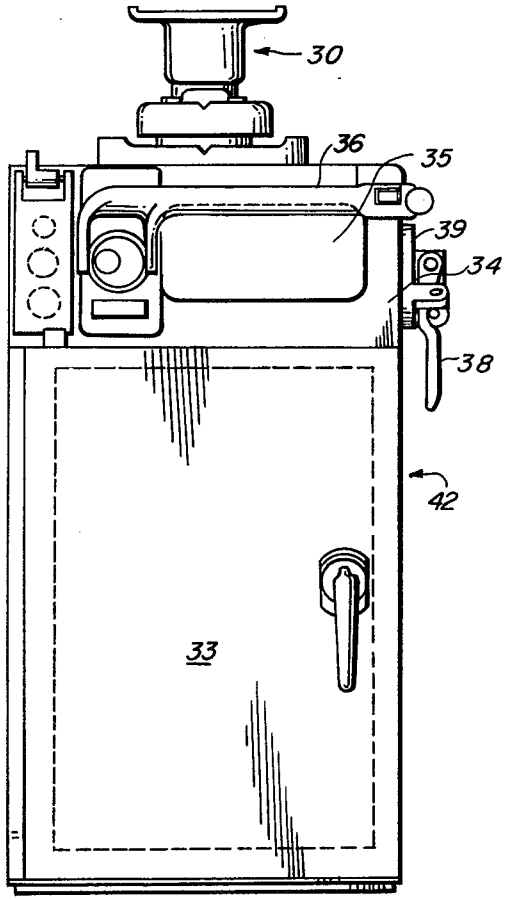
FIG. 2 is a front plane view of the improved switch operating mechanism illustrated in FIG. 1.

With references to FIGS. 2, 3, and 4, the reference character 42 designates, generally, frame means which includes the weatherproof housing 32 and frame plates and angle shaped frame parts that are not specifically identified herein. The shaft coupling and bearing assembly 30 is mounted on top of housing 32 and has depending therefrom a shaft extension 43 (see FIG. 6A) which is connected directly to the switch drive shaft 29 and rotates conjointly therewith. The shaft extension 43 is suitably mounted by bearings 41 so that it will rotate freely.

With respect to FIG. 3, mounted inside housing 32 are a variety of components including motor 50, auxiliary switch 52, extra auxiliary switch 54, motor open contactor switch 56, motor close contactor switch 58, position indicating lamps 60, utility lamp outlet and switch 62, and terminal blocks 84. Auxiliary switch 52 is constructed in accordance with U.S. Pat. No. 3,852,542 — Rogers et al., issued Dec. 3, 1974 and operates in the manner described therein and does not form a part of the present invention.

Figure 5A:
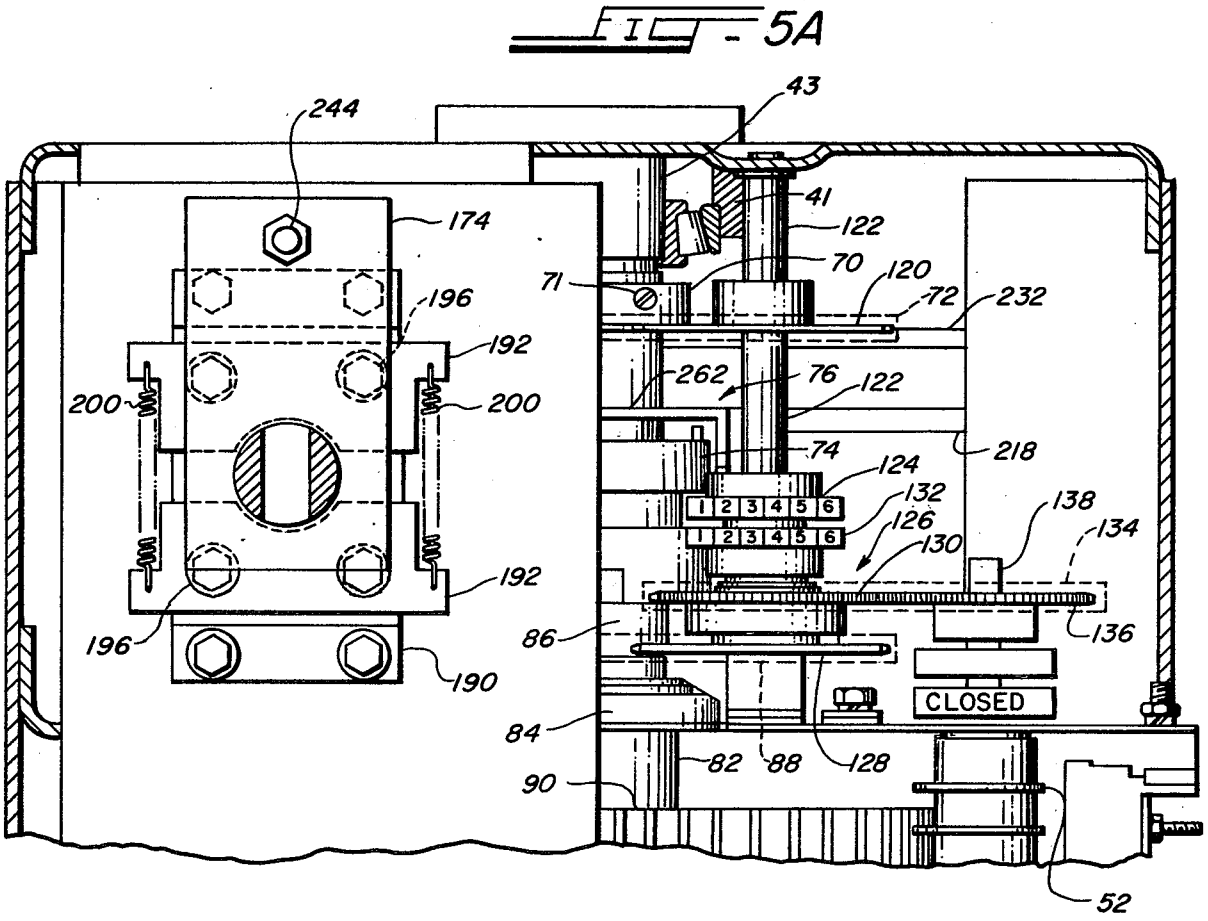
FIG. 5A is an enlarged front partially fragmentary partially cross sectional view of the upper portion of the improved switch operating mechanism illustrated in FIG. 3.
Figure 6A:
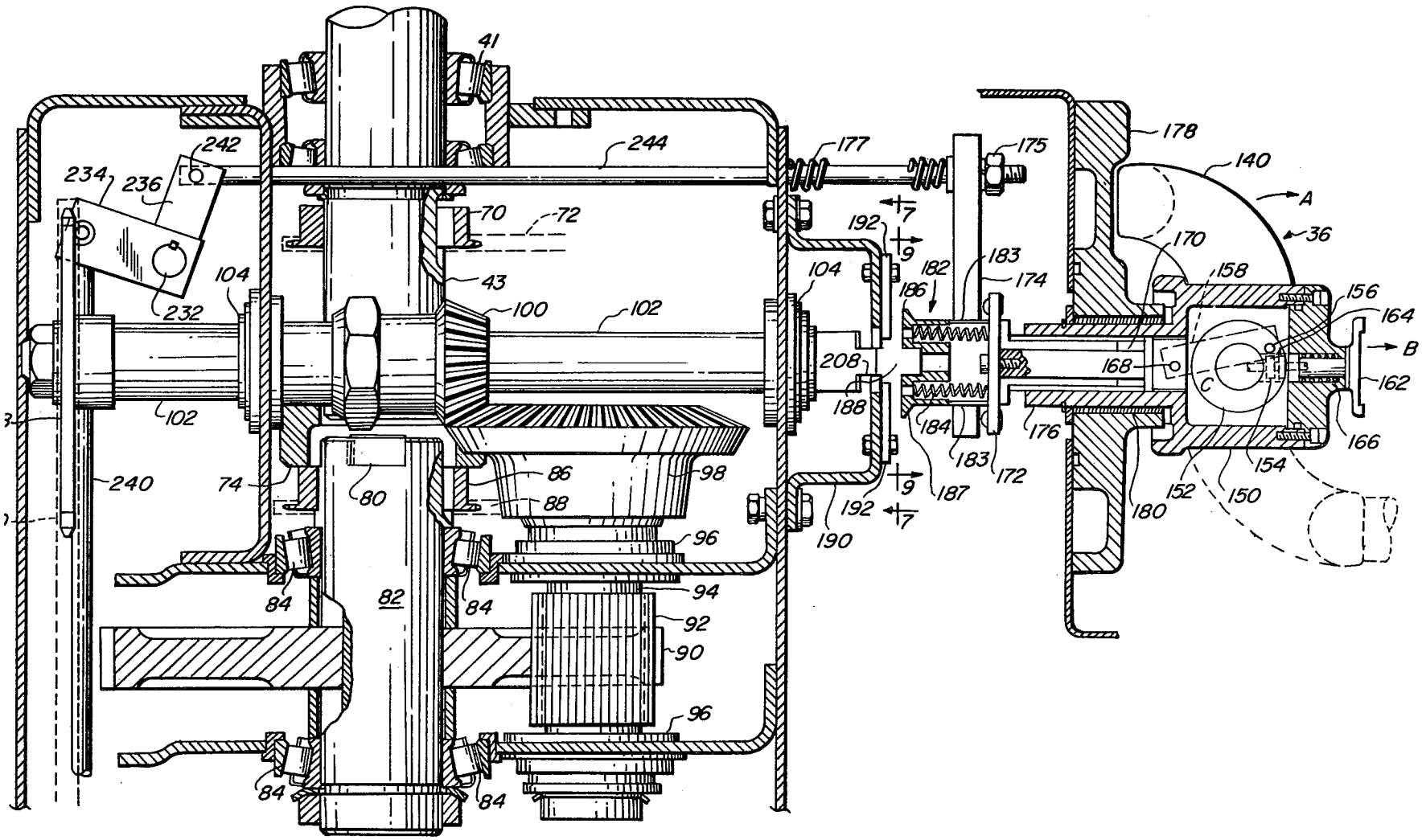
FIG. 6A is a left side partially fragmentary partially cross sectional view of the upper portion of the improved switch operating mechanism in accordance with the present invention.

With reference to FIGS. 5A and 6A, shaft extension 43 extends through the top of housing 32 and is supported by bearings 41 for rotation as previously described. Mounted on shaft extension 43 immediately below bearing 41 is a sprocket 70 firmly mounted on shaft extension 43 by a set screw 71 so that sprocket 70 and shaft extension 43 rotate conjointly. Trained around sprocket 70 is a drive chain 72 indicated generally by dotted lines in FIGS. 5A, and 6A. The lower end of shaft extension 43 has splines 73 suitably formed receive a mating splined coupling 74 that forms a part of motor clutch assembly 76. Splined coupling 74 is adapted to slide vertically on the end of shaft extension 43 but to rotate conjointly therewith.

Figure 19:
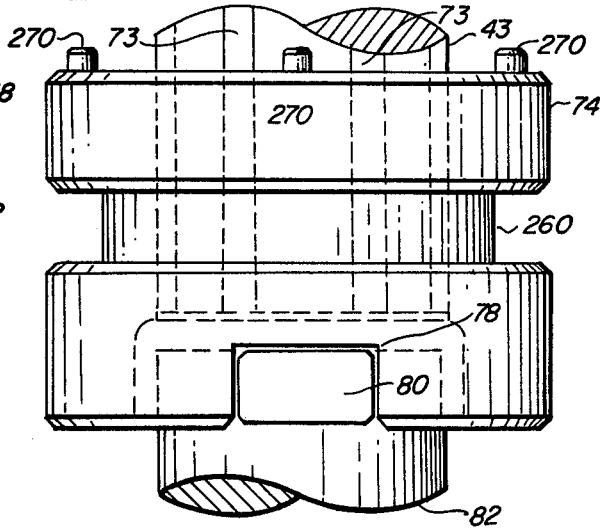
FIG. 19 is a side partially fragmentary view of the splined coupling and clutch coupling bar arrangement of the present invention.

With reference to FIG. 19, splined coupling 74 has formed in the lower end thereof a slot 78 for receiving a coupling bar 80 that is mounted on the end of a shaft 82. Thus, in the position illustrated in FIG. 19, when shaft 82 is rotated, coupling bar 80 engages slot 78 causing splined coupling 74 to rotate shaft extension 43 through the splined connection between shaft extension 43 and splined coupling 74.

With reference to FIG. 6A, shaft 82 is suitably mounted for rotation by bearings 84. Firmly mounted on shaft 82 is a sprocket 86 over which is trained a drive chain 88 indicated generally by the dotted lines in FIG. 6A. Sprocket 86 is also attached to shaft 82 by a set screw (not shown) so that sprocket 86 rotates with shaft 82. Also mounted on shaft 82 is a gear 90 that also rotates with shaft 82. Gear 90 engages a driving gear 92 firmly mounted on a shaft 94 that is suitably mounted for rotation by bearing assemblies 96. Mounted to the top of shaft 94 is a bevel gear 98 that also rotates with shaft 94. Bevel gear 98 engages another bevel gear 100 that is firmly attached to a shaft 102. Shaft 102 is suitably mounted for rotation by bearing assemblies 104. Mounted to one end of shaft 102 by a nut 106 is a sprocket 108 over which is trained a drive chain 110 indicated generally by dotted lines in FIG. 6A.

Figure 5B:
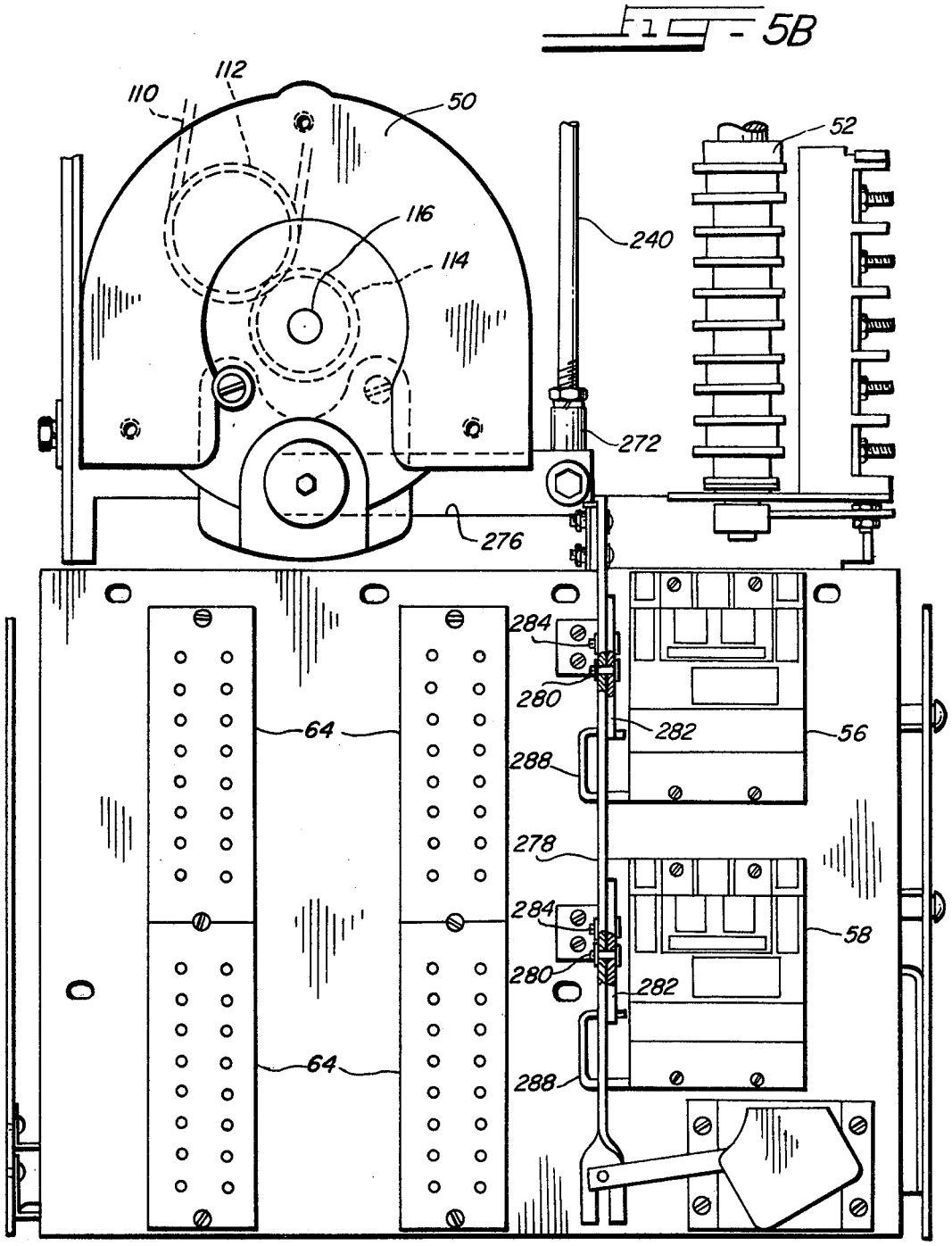
FIG. 5B is an enlarged front partially fragmentary view of the lower portion of the improved switch operating mechanism illustrated in FIG. 3.

With reference to FIG. 5B, drive chain 110 is also trained around a geared sprocket 112 which engages a gear 114 on the shaft 116 of motor 50. Thus, operation of motor 50 causes drive chain 110 to rotate sprocket 108 which in turn rotates shaft 102 causing bevel gear 100 to rotate bevel gear 98 and shaft 94. Rotation of shaft 94 causes gear 92 to rotate gear 90 which in turn causes shaft 82 to rotate. Rotation of shaft 82 causes splined coupling 74 and shaft extension 43 to rotate because coupling bar 80 engages slot 78 in splined coupling 74. Thus, the operation of motor 50 causes the previously described gear train to rotate shaft extension 43 which in turn rotates drive shaft 29 through coupling assembly 30 to cause operation of the high voltage switch 10.

With reference to FIG. 5A, drive chain 72 is trained around a sprocket 120 that is mounted on a shaft 122 that is mounted for rotation within housing 52. Thus, when sprocket 70 is rotated when shaft extension 43 is rotated, drive chain 72 causes sprocket 120 and shaft 122 to rotate. Mounted for rotation with shaft 122 is a position indicating drum 124 that rotates with shaft 122.

A sprocket assembly 126 is mounted for rotation around shaft 122, but is free to rotate independently of shaft 122. Sprocket assembly 126 comprises a sprocket 128 over which is trained drive chain 88 the other end of which is trained around sprocket 86 mounted on shaft 82 (see FIG. 6A). Thus, sprocket 86 is rotated when shaft 82 is rotated causing drive chain 88 to rotate sprocket 128. Mounted to rotate conjointly with sprocket 128 is a sprocket 130 and a position indicating drum 132. Thus, when drive chain 88 rotates sprocket 128, sprocket 130 and position indicating drum 132 are also rotated around and independent of shaft 122. Trained over sprocket 130 is a drive chain 134 which engages a sprocket 136 mounted on the end of shaft 138 of auxiliary switch 52. Thus, rotation of sprocket 136 causes the operation of auxiliary switch as more specifically described in U.S. Pat. No. 3,852,542 — Rogers, et al.

Figure 18:
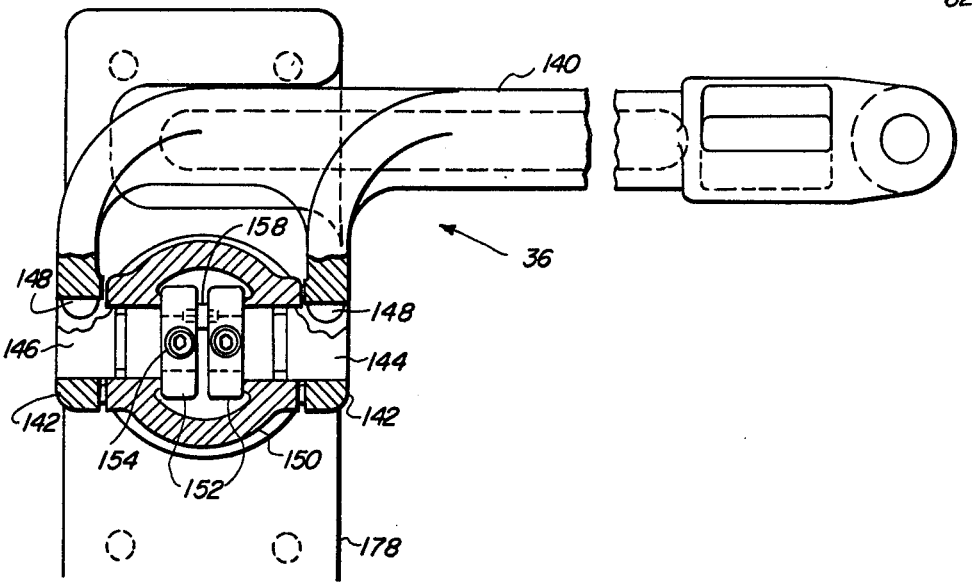
FIG. 18 is a front partially cross-sectional view of the manually operable crank handle of the present invention.

With reference to FIGS. 6A and 18, a crank handle assembly 36 substantially similar to the assembly illustrated in U.S. Pat. No. 3,508,798 — Bernatt et al. is illustrated. However, some improvements hereinafter described have been made to this assembly. Crank handle assembly 36 comprises a handle 140 that is normally folded in a folded position over the front of housing 32. Handle 140 has a bifurcated end forming arms 142 having circular openings therein through which extend shafts 144 and 146. Shafts 144 and 146 are keyed to arms 142 by keys 148 so that rotation of handle 140 in the direction indicated by arrow A in FIG. 6A causes shafts 144 and 146 to also rotate. Shafts 144 and 146 are supported for rotation by a crank handle support 150. Mounted to the ends of shafts 144 and 146 within crank handle support 150 by set screws 154 are drive discs 152. Pinned between drive discs 152 by a pin 156 is a drive link 158. The other end of link 158 is pinned to push rod 170 by pin 168. A cover 160 is bolted to the end of crank handle support 150 and a latch pull knob 162 is mounted through cover 160. Screwed into the end of latch pull knob 160 is a bolt 164 which engages an opening in the edge of drive disc 152 so that drive disc 152 cannot be rotated until latch pull knob 62 is moved in the direction of arrow B in FIG. 6A. A spring 166 normally urges pull knob 162 in a direction opposite of arrow B in FIG. 6A.

When latch pull knob 162 is pulled out, handle 140 can be pivotted in the direction of arrow A which in turn causes drive discs 152 to rotate in the direction of arrow C in FIG. 6A. This causes link 158 to push against pin 168 through the end of push rod 170 causing push rod 170 to move in the direction of arrow D in FIG. 6A. Mounted on the end of push rod 170 is a strap 172 which engages against a plate 174 to move plate 174 in the direction of arrow D in FIG. 6A. Plate 174 is mounted on a rod 244 by a bolt 175 and is urged to the right as viewed in FIG. 6A by spring 177.

Crank handle support 150 has a reduced portion 176 which extends through a front cover support 178 and is supported for rotation by a bearing 180. Splined within the end of reduced portion 176 is a piston assembly 182. Piston assembly 182 comprises springs 184 that ride against strap 172 thereby urging piston assembly 182 in the direction of arrow D in FIG. 6A. Strap 172 extends through slots 183 in piston assembly 182. Thus, when push rod 170 is moved in the direction of arrow D in FIG. 6A, piston assembly 182 also tends to move in the direction of arrow D under the urging of springs 184. The splined connection between piston assembly 182 and reduced portion 176 of crank handle support 150 causes piston assembly 182 to rotate with handle 140 but allows piston assembly to move laterally within reduced portion 176.

Figure 9:
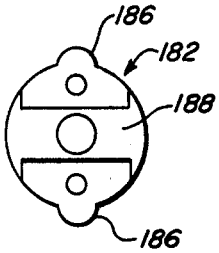
FIG. 9 is a view of the piston assembly of the present invention taken substantially along line 9—9 in FIG. 6A.

With reference to FIGS. 6A and 9, the end of piston assembly 182 is generally circular but has formed thereon ears 186 which extend radially from the circumference thereof. Also formed in the end of piston assembly 182 is a slot 188, the purpose of which will be more fully described hereinafter.

Figure 7:
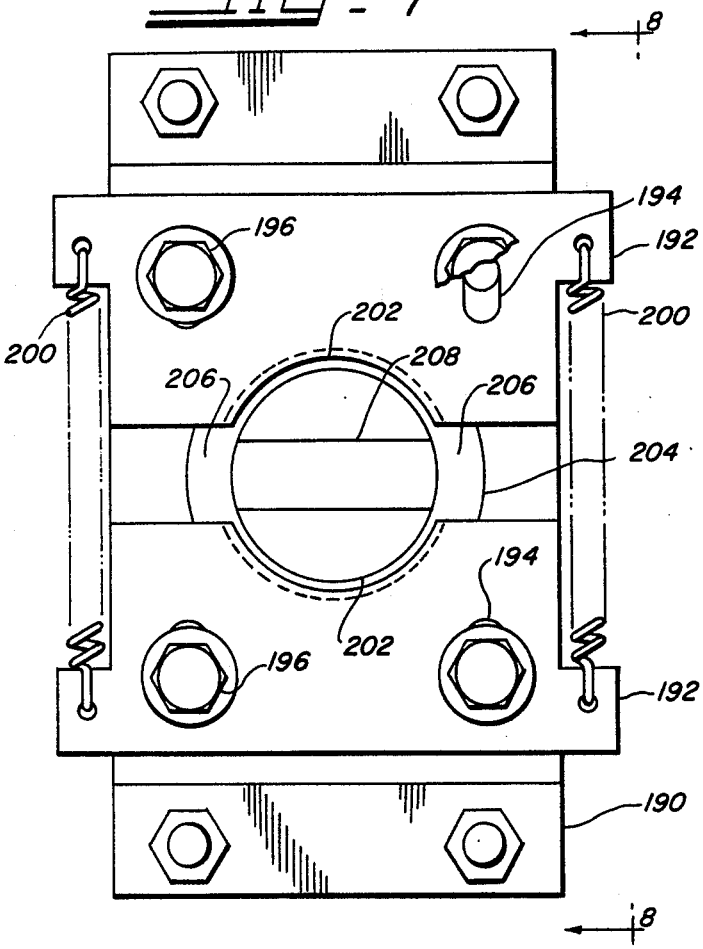
FIG. 7 is a view taken substantially along line 7—7 in FIG. 6A.
Figure 8:
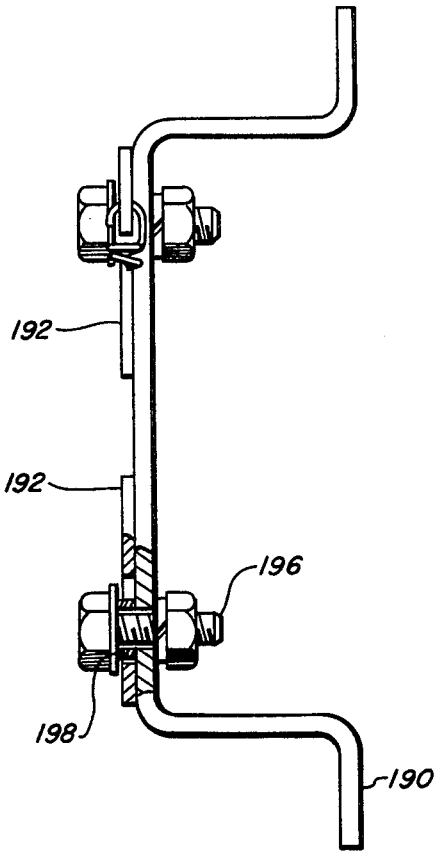
FIG. 8 is a side partially cross sectional view taken substantially along line 8—8 in FIG. 7.

With reference to FIGS. 6A and 7, mounted to an interior wall of housing 32 is a support bracket 190 on which are mounted plates 192. With reference to FIGS. 7 and 8, plates 192 have formed therein slots 194 through which bolts 196 extend. Spacers 198 are positioned within slots 194 to hold the head of bolt 196 away from plates 192 so plates 192 can ride freely along slots 194. Springs 200 are connected between plates 192 so that plates 192 are generally urged towards one another. Plates 192 have a semi-circular opening 202 formed in opposite edges thereof overlying a larger opening 204 in bracket 190. In their normal position, plates 192 are separated leaving a space 206 therebetween. The diameter of the semi-circular openings 202 is sufficiently large to allow the circular portion of the end of piston assembly 182 to pass therethrough, but not sufficiently large to allow ears 186 to pass therethrough. Ears 186 must be aligned with the openings 206 between plates 192 before piston assembly 182 can be moved between plates 192. Formed on the end of shaft 102 is a flattened extension 208 which is dimensioned to engage the slot 188 in the end of piston assembly 182. Ears 186 have a beveled surface 187 on the backside thereof which is sufficiently slanted to allow the ears 186 to spread plates 92 when piston assembly 182 is withdrawn from between plates 182.

Figure 13:
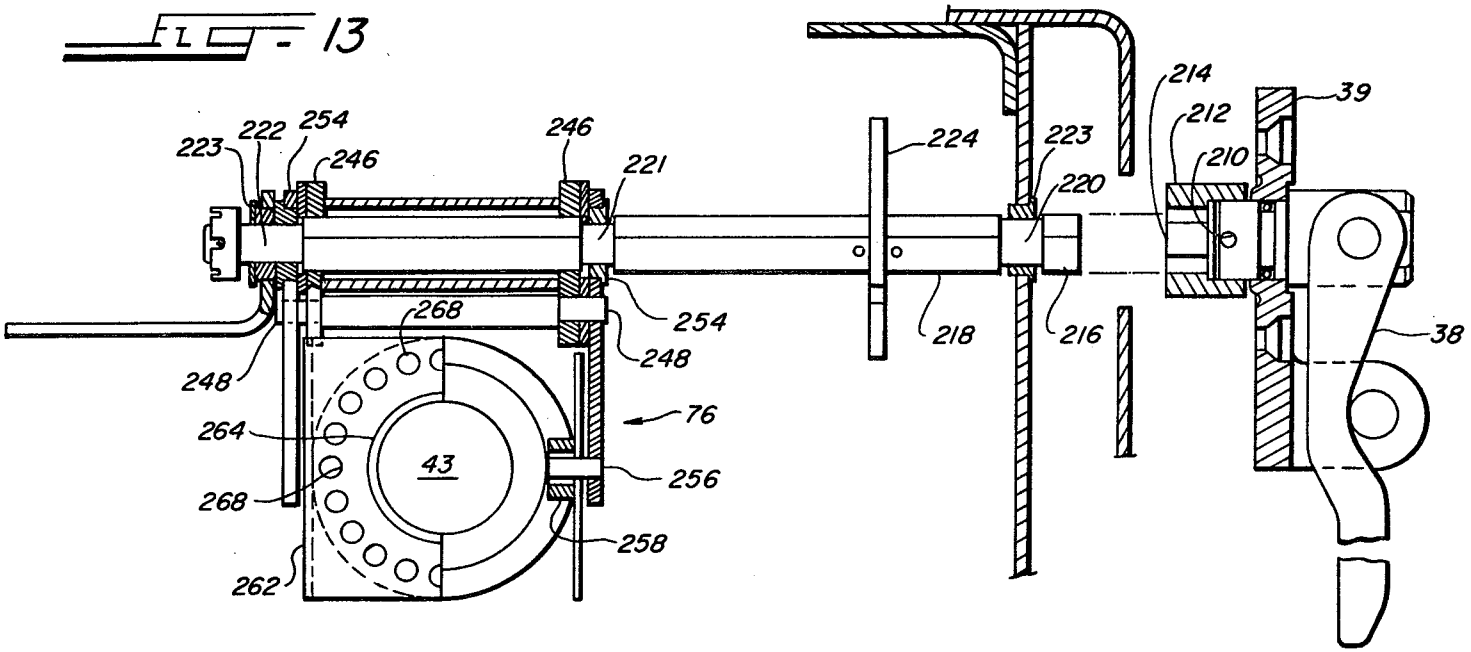
FIG. 13 is a top view of the selector handle and locking arrangement in accordance with the present invention.
Figure 15:
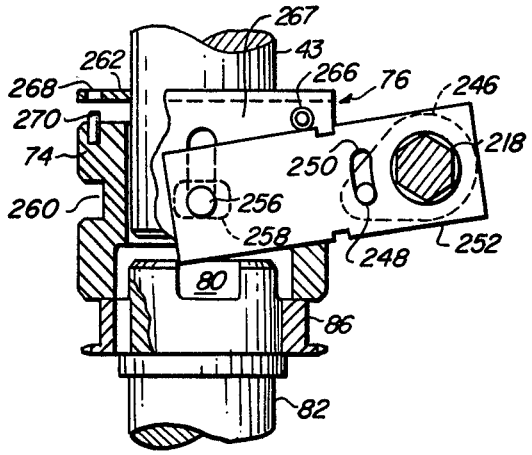
FIG. 15 is a side partially cross-sectional view of the splined coupling and locking arrangement of the present invention.

With reference to FIG. 13, selector handle 38 and selector handle mount 39 are shown turned exactly 90° with respect to the top view shown in FIG. 13 so that the construction of handle 38 and mount 39 could be described with respect to a side view. Selector handle 38 is mounted for rotation through handle mount 39, and mounted to the end of selector handle 38 by pin 210 is a sleeve 212 having a hexagonal opening 214 formed in the end thereof. Hex opening 214 is adapted to engage the hexagonal end 216 of shaft 218. Shaft 218 is generally hexagonally shaped but has rounded portions 220 and 222 that ride in bearings 223 so that shaft 218 can freely rotate. Mounted on shaft 218 for rotation therewith is a cam 224.

Figure 11:
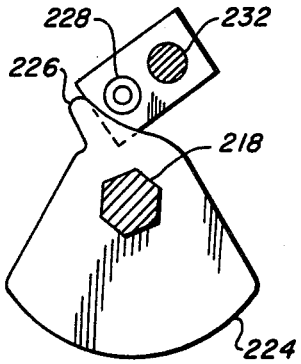
FIG. 11 is a side partially cross-sectional view of the cam mechanism illustrated in FIG. 10.
Figure 12:
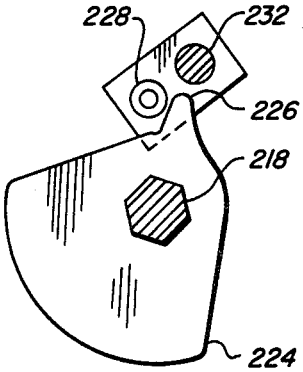
FIG. 12 is a side partially cross-sectional view of the cam mechanism shown in an operated position.
Figure 10:
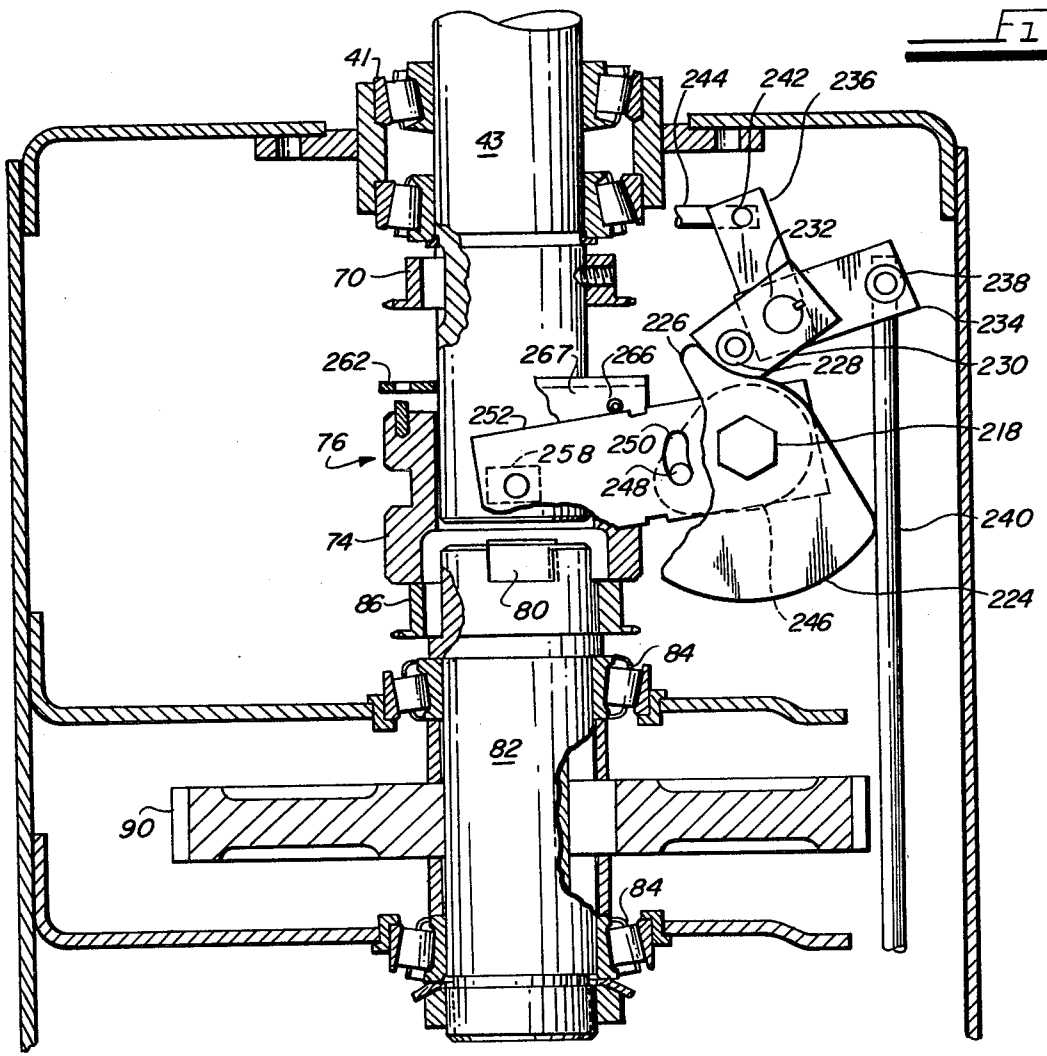
FIG. 10 is a right side partially fragmentary partially cross sectional view of the upper portion of the improved switch operating mechanism in accordance with the present invention.
Figure 14:
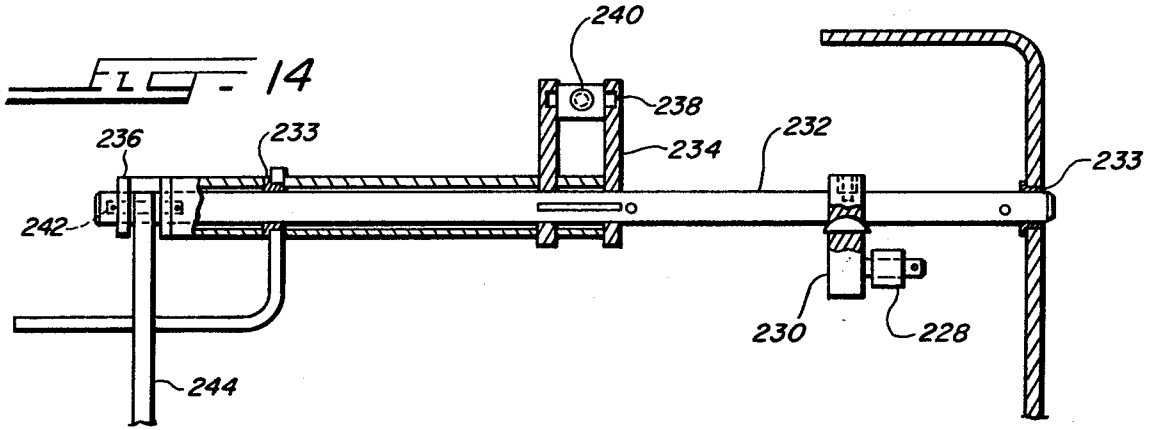
FIG. 14 is a top view of the follower and shaft arrangement illustrated in FIG. 10.

With reference to FIGS. 10 and 14, a protrusion 226 on cam 224 rides against a roller 228 pinned to arm 230 mounted and keyed on a shaft 232. Shaft 232 is rotatably mounted by bearings 233. Also mounted and keyed to shaft 232 are arms 234 and 236. Connected to the end of arm 234 by a pin 238 is a connecting rod 240. Connected to the end of arm 236 by a pin 242 is a connecting rod 244. Rotation of shaft 218 and cam 224 in a clockwise direction as viewed in FIGS. 10 and 11 causes arm 230 to be pivoted in a clockwise direction when protrusion 226 pushes against roller 228. This clockwise rotation causes arms 234 and 236 to pivot in a clockwise direction as viewed in FIG. 10 causing connecting rod 240 to move downwardly and connecting rod 244 to move towards the right as viewed in FIG. 10. Accordingly, the pivoting of handle 38 from the position illustrated by the solid lines in FIG. 4 to the position illustrated by the dotted lines in FIG. 4 causes cam 224 to pivot from the position illustrated in FIGS. 10 and 11 to the position illustrated in FIG. 12 causing arms 234 and 236 to pivot as previously described.

With reference to FIGS. 13, 15, 16, 17 and 19, motor clutch assembly 76 is illustrated. Mounted for rotation on shaft 218 are cam arms 246 that have formed therethrough a hexagonal opening that engages with shaft 218 so that cam arms 246 pivot with shaft 218. Mounted on the end of cam arms 246 are pins 248 which ride in slots 250 in the side of lever arms 252. Lever arms 252 are mounted on bearings 254 which ride on rounded portions 221 of shaft 218 so that lever arms 252 can freely pivot between the two positions illustrated in FIG. 17. Mounted to the end of lever arms 252 by shaft 256 are slides 258 (only one of which is shown) which ride in a groove 260 formed circumferentially around splined coupling 74.

Figure 16:
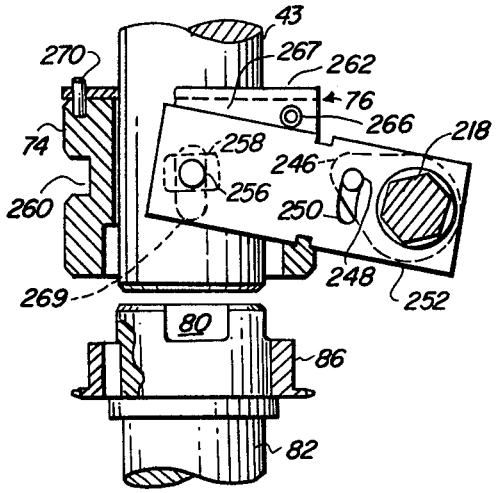
FIG. 16 is a view of the splined coupling and locking arrangement of the present invention shown in the locked position.
Figure 17:
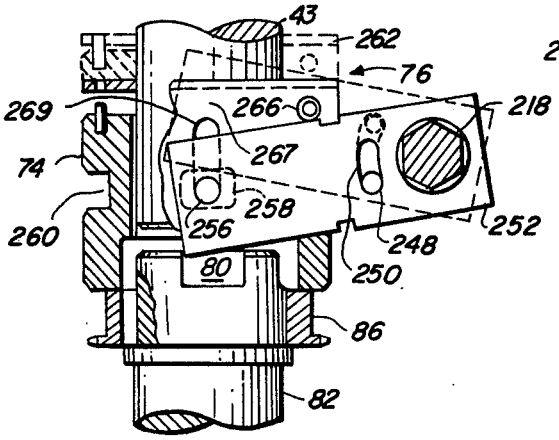
FIG. 17 is a view showing the splined coupling and locking arrangement being moved between its two positions.

A lock plate 262, having circular opening 264 through which shaft extension 43 extends, normally rides above spline coupling 74. Lock plate 262 has rollers 266 pinned to side flanges 267 thereof which ride on the upper edge of lever arms 252. Flanges 267 have slots 269 through which shafts 256 extend. Lock plate 262 has a series of small circular openings 268 equally spaced at a constant radius around the center of circular opening 264 and aligned to engage pins 270 in splined coupling 74 when splined coupling 74 is moved in upward direction as illustrated in FIG. 16.

Figure 6B:
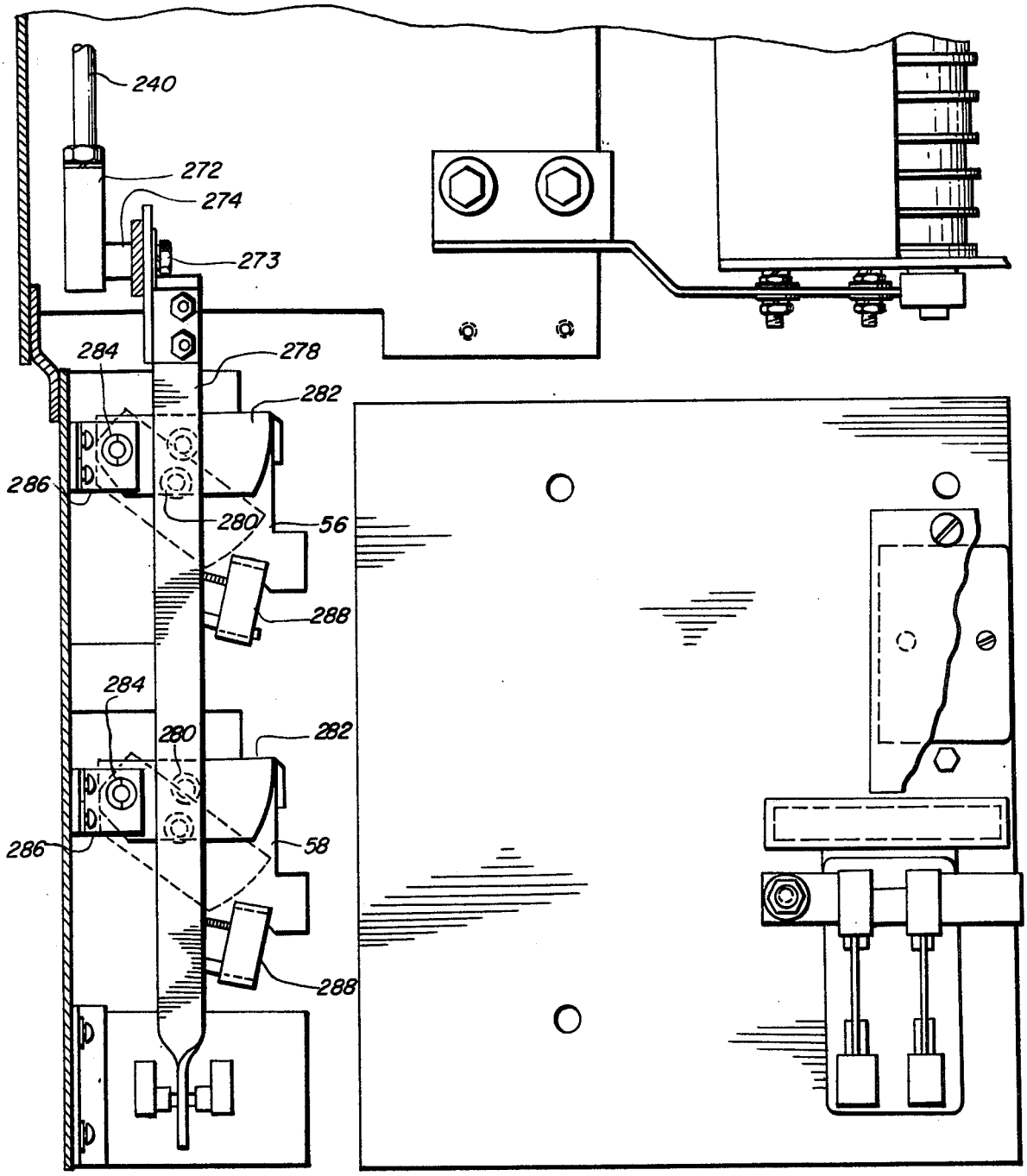
FIG. 6B is a left side partially cross-sectional, partially fragmentary view of the lower portion of the improved switch operating mechanism in accordance with the present invention.

With reference to FIGS. 5B and 6B, rod 240 extends downwardly and the end thereof is connected to a fitting 272. Mounted to the end of fitting 272 is a bolt 273 and a spacer 274 upon which pivotably rides brake lever 276. Also connected to fitting 272 by bolt 273 is a vertically extending arm 278. Thus, downward movement of rod 240 causes brake lever 276 to pivot downwardly and also causes arm 278 to move downwardly.

Brake lever 276 is connected to a brake mechanism (not shown in detail), which locks motor 50 whenever motor 50 is not in operation. Such a typical lock arrangement is more specifically described in U.S. Pat. No. 3,508,179 — Bernatt et al. and does not specifically form a part of the present invention. However, it should be understood that the brake mechanism prevents the rotation of shaft 29 so that the high voltage switch 10 remains in whatever position it was in when the motor 50 ceased operation. This prevents the switch from accidentally opening or closing as a result of wind or vibrational forces. The motor brake is ordinarily operated by a solenoid arrangement (not shown) which immediately unlocks the motor when power is applied to the motor 50. However, the brake can be mechanically operated by the movement of brake lever 276. Downward movement of rod 240 causes the brake to release and the brake is locked when brake lever 276 is in the position shown in FIG. 5B.

Pivotably mounted to arm 278 by pins 280 are switch cams 282. Switch cams 282 are pivotably mounted at one end by pins 284 supported by brackets 286 so that downwardly movement of arm 278 will pivot switch cams 282 from the position illustrated in solid lines in FIG. 6B to the position illustrated by dotted lines in FIG. 6B so that the edge of cams 282 engage follower arms 288 on motor contactor switches 56 and 58. Switches 56 and 58 are solenoid operated switches which are operated to control the operation of motor 50 from appropriate control circuitry. However, when switch cams 280 are moved to engagement with follower arms 288, switches 56 and 58 are mechanically disabled so that they cannot operate to supply power to motor 50.

Switch operating mechanism 31 is adapted for operation either automatically or manually. Automatic operation is effected by appropriate control circuitry (not shown) to effectuate motorized operation of mechanism 31 as generally described in U.S. Pat. No. 3,508,179 — Bernatt et al. The automatic operation of mechanism 31 does not form a part of the present invention but for explanatory purposes, a brief description will be given. Assuming that switch 10 is in a closed position, receipt of an appropriate control signal (indicating for example a fault condition) causes motor open contactor switch 56 to operate supplying power to motor 50 so that it will rotate in a direction to cause the gears to rotate to pivot drive shaft 29 in a direction to open switch 10. Similarly, receipt of an appropriate signal to close switch 10 causes motor close contactor switch 58 to operate to cause motor 50 to reverse directions and rotate drive shaft 29 in the opposite direction to close switch 10.

However, it is often desirable to operate mechanism 31 manually or to disconnect drive shaft 29 so that the mechanism 31 can be operated to determine whether it will operate properly without operating switches 10. The present invention involves improved means for manually operating and disconnecting mechanism 31.

If it is desired to manually operate mechanism 31, handle 140 of crank handle assembly 36 is pivoted in the direction of arrow A in FIG. 6A until it reaches the position generally indicated by the dotted lines in FIG. 6A. As previously described, this rotation cause link 158 to push rod 170 in the direction of arrow D in FIG. 6A so that strap 170 pushes against plate 174 causing plate 174 and rod 244 to move towards the left as viewed in FIG. 6A. Since rod 244 is connected to arm 236, arm 236 is pivoted in a counterclockwise direction as viewed in FIG. 6A causing arm 234 to also pivot in a counterclockwise direction on shaft 232. This causes rod 240 to move in a downward direction, and as previously described with respect to FIGS. 5B and 6B, this downward movement of rod 240 causes brake lever 276 to pivot downwardly releasing the brake on motor 50 and switch cams 282 to engage follower arms 288.

Since drive shaft 29 and interphase shafts 27 are relatively long members, torsional energy may be stored in these members as a result of the previous operation of mechanism 31. This torsional energy is stored as a result of the operation of the motor brake, but when the brake is released, the torsional energy is released causing pivotal movement of shaft 29. Since there is a direct gear train connection between shaft 29 through shaft extension 43, shaft 82, gear 90, gear 92, bevel gear 98, and bevel gear 100 to shaft 102, the torsional energy stored in drive shaft 29 and interphase shafts 27 will cause a sudden although relatively small angular rotation of shaft 102. If handle 140 were directly connected to shaft 102, the release of this torsional energy could result in an undesirable rapid rotation or whipping of handle 140.

To avoid possible sudden rotation or whipping of handle 140 as a result of the release of this torsional energy, the present invention is designed to prevent coupling between shaft 102 and handle 140 until this torsional energy has been released. Specifically, as previously pointed out, when handle 140 is pivoted to the operating position, piston assembly 182 is moved in the direction of arrow D in FIG. 6A but ears 186 engage the edge of plates 192 preventing slot 88 from engaging the flattened extension 208 on the end of shaft 102 until such time as piston assembly 182 is rotated until ears 186 are aligned with openings 206 between plates 192 so that springs 184 can urge piston assembly 182 into engagement with shaft 102. Since the release of the torsional energy is almost instantaneous upon release of the motor brake, and since it takes a period of time for the operator to pivot the handle to a position where the ears 186 on piston assembly 182 align with the openings 206, the torsional energy is dissipated before there can be a direct mechanical linkage between the handle 140 and the end of shaft 102. Once slot 188 engages flattened extension 208 on the end of shaft 102, handle 140 can be pivoted to cause shaft 102 to rotate which in turn causes shaft 29 to rotate through the previously described gear train.

An additional feature of the present invention is that rod 240 is moved downwardly as handle 140 is pivoted to an operating position as a result of the engagement of strap 172 with plate 174. Consequently, arm 278 is also moved downwardly until switch cams 282 engage follower arms 288 on switches 56 and 58 disabling the switches so that if an automatic control signal is received while the handle is in the operating position, the motor will not operate. This is a very important feature since operation of the motor would cause a hazardous rapid rotation of the handle 140.

Once the desired manual operation has been completed, handle 140 is pivoted back to the position illustrated by the solid lines in FIG. 6A causing link 158 to pull push rod 170 in a direction opposite to the arrow D in FIG. 6A thereby pulling piston assembly 182 towards the right as viewed in FIG. 6A. The beveled surfaces 187 on ears 186 are sufficiently slanted to cause plates 192 to spread under the urging of springs 200 so that piston assembly 182 can be disengaged from the end of shaft 102 and withdrawn from between plates 192.

It is also often desirable to disconnect mechanism 31 from shaft 29 so that mechanism 31 can be operated either manually or automatically to assure proper operation thereof without concurrent operation of the switch 10. However, since it is not desirable to allow shaft 29 to be in an unlocked condition which could result in switch 10 accidentally opening or closing as a result of wind or vibrational forces, it is also desirable to lock shaft 29 while the checkout procedures are being performed on mechanism 31. The present invention provides an improved means for disconnecting mechanism 31 and locking shaft 29.

Specifically, with reference to FIG. 4, when handle 38 is pivoted from the position illustrated in the solid lines in FIG. 4 to the position illustrated by the dotted lines, there is a corresponding rotation of shaft 218 (see FIGS. 10 and 13). Rotation of shaft 218 causes cam 224 to rotate causing protrusion 226 to engage roller 228 causing arm 230 to rotate in a clockwise direction as viewed in FIG. 10. This causes shaft 232 to rotate which in turn causes arm 234 to pivot in a clockwise direction driving rod 240 in a downward direction. The downward movement of rod 240 causes the motor brake to release as previously described and also causes switch cams 282 to engage follower arms 288 on switches 56 and 58.

Rotation of shaft 218 also causes cam arms 246 to rotate in a clockwise direction as viewed in FIG. 10 until pin 248 engages the top of slot 250 causing lever arms 252 to pivot upwardly as illustrated in FIG. 16. When lever arms 252 pivot upwardly, slide 258 is concurrently moved upward causing it to engage the upper surface of groove 260 is splined coupling 74, causing splined coupling 74 to move upwardly on shaft extension 43 until slot 78 disengages coupling bar 80 on shaft 82 so that shaft 82 is no longer coupled to shaft extension 43. Concurrently with the upward movement of splined coupling 74, rollers 266 on lock plate 272 roll along the upper surface of lever arms 252 causing lock plate 262 to move slightly upwardly. However, since splined coupling 74 moves upwardly further and at a different rate of travel than lock plate 262, pins 270 on splined coupling 74 engage the small circular openings 268 in lock plate 262 locking coupling 74 to lock plate 262 as illustrated in FIG. 16. In this position, splined coupling 74 is prevented from rotating so that shaft extension 43 and connected drive shaft 29 are also locked in position. However, since slot 78 in coupling 74 no longer engages coupling bar 80, shaft 82 can be rotated either by motor 50 or by manual operation as previously described without causing a concurrent rotation of output shaft 29.

In the event pins 270 are not aligned to enter small circular openings 268, lock plate 262 will ride on top of pins 270 until a slight rotation of splined coupling 74 occurs, after which lock plate 262 will drop into the locked position. To minimize the free rotation which may occur, it is advantageous to provide small angular spacing between openings 268, the number of openings being an integral multiple of the number of pins 270.

As previously described, when cam 244 is rotated, rod 240 is moved downwardly thereby releasing the motor brake and blocking the operation of switches 56 and 58. However, as roller 228 rides over the end of protrusion 226, roller 228 rotates back to the position illustrated in FIG. 12 thereby releasing the switches 56 and 58 so that the motor can be operated. It is important that motor 50 not be operated while handle 30 is being pivoted to avoid damage to the mechanism. However, once coupling 74 has disengaged coupling bar 80, it is desirable to permit operation of the motor 50 so that the automatic control circuitry can be checked to ascertain whether it is operating properly.

To return the mechanism 31 back to its original position, handle 38 is pivoted back to the position illustrated by the solid lines in FIG. 4 which causes a reverse of the operation previously described. Shaft 218 is rotated in a counterclockwise direction as viewed in FIG. 10 causing cam arms 246 to pivot in a counterclockwise direction as viewed in FIGS. 10, 15 and 17 which allows spline coupling 74 to move downwardly until pins 270 no longer engage openings 268 in lock plate 262, and mechanism 31 is ready for either automatic or manual operation.

It should be expressly understood that various alterations, changes, and modifications may be made to the embodiment as herein described without departing from the spirit and scope of the present invention as defined in the appended claims.

I claim:

1. In a mechanism for operating a high voltage switch including a rotatably mounted drive shaft connected to the switch for opening and closing the switch in response to rotation of the drive shaft, a motor, and a gear train operably connected to the motor, a clutch means disengageably connecting the gear train to the drive shaft, a selector handle mounted for pivotable movement between a first and a second position; a selector shaft connected to said selector handle for pivotable movement with the selector handle; means operably connected with the selector shaft for causing the clutch means to engage the gear train when the selector handle is in the first position, and for causing the clutch means to disengage the gear train when the selector handle is in the second position; an improvement comprising:

a locking plte positioned around the drive shaft adapted to move along the drive shaft but constrained from rotating with the drive shaft, said locking plate having a plurality of openings therein, the clutch means having a plurality of pins extending from the clutch means, said pins positioned to engage said openings in said locking plate when the clutch means disengages the gear train so that the drive shaft is prevented from rotating, and said pins disengaging said openings when the clutch means engages the gear train so that the drive shaft can be rotated by the gear train.

2. The improvement, as claimed in claim 1, further comprising cam means mounted for rotation on selector shaft, follower means engaging said cam means, means operably associated with said follower means for rendering the motor inoperable while the selector handle is being pivoted between its first and second positions.

3. The improvement, as claimed in claim 1, wherein said locking plate can move along the drive shaft if said plurality of openings formed therein are not aligned to engage said pins on said clutch means until the drive shaft moves to align said openings with said pins so that said pins engage said openings locking the drive shaft.

4. In a high voltage switch operating mechanism including a rotatably mounted drive shaft connected to a high voltage switch for causing the switch to open and close in response to rotation of the drive shaft; a coupling means mounted for rotation with the drive shaft and mounted for sliding movement along the drive shaft between a first position and a second position, the coupling means having a first engaging means associated therewith; a motor driven means having a second engaging means associated therewith for engaging the first engaging means when the coupling means is in its first position and for disengaging the first engaging means when the coupling means is in its second position; means for moving said coupling means between its first and second position in response to manual selection; an improved locking arrangement comprising:

means for locking said drive shaft to prevent rotation thereof when the coupling means is moved to its second position comprising a locking plate positioned around the drive shaft and free to move along said drive shaft but constrained from rotating with the drive shaft, said locking plate having a plurality of openings therein adapted to engage pins extending from the coupling means when the coupling means is moved to its second position and for disengaging said pins when the coupling means is moved to its first position.

5. In a mechanism for operating a high voltage switch including a rotatably mounted drive shaft operably connected to the switch, a motor, a gear train operably connecting the motor with the drive shaft, a brake for locking the motor upon deenergization thereof, a manually operably crank handle foldable from a stored position to an operating position; means for releasing the brake upon folding of said crank handle to an operating position; a piston means operably connected with the crank handle for rotation therewith, and for translational motion in response to folding of the crank handle from a stored position to an operating position, the piston means including engaging means associated therewith for engaging the gear train so that rotation of the crank handle will rotate the drive shaft; an improvement comprising:

means for preventing the engaging means from engaging the gear train until the crank handle has both been folded to the operating position and rotated through a partial revolution thereof so that torsional energy stored in the drive shaft is released before the engaging means engages the gear train.

6. The improvement, as claimed in claim 5, wherein said means for preventing the engaging means from engaging the gear train comprises:

a first plate and a second plate slidably mounted for spreadable movement, said first and second plates having an opening there-between dimensioned to prevent admission of the piston means when the crank handle is folded from a stored position to an operating position, but which allows admission of the piston means so that the engaging means will engage the gear train when the crank handle is rotated through a partial revolution thereof.

7. The improvement, as claimed in claim 6, further comprising spring means biasing said first and second plates toward one another.

8. The improvement, as claimed in claim 6, wherein the piston means has ears projecting therefrom which engage said first and second plates when said crank handle is folded from its stored position to its operating position causing compression of spring means within the piston means, and said ears disengage said first and second plates so that said spring means can urge the engaging means to engage the gear train when the crank handle pivots the piston means through a partial revolution.

9. The improvement, as claimed in claim 8, wherein said ears have an inclined surface on a rear side thereof capable of causing said plates to separate to allow the piston means to be withdrawn from the opening between said first and second plates when the crank handle is folded back to its stored position.

10. The improvement, as claimed in claim 5 comprising means for disabling the motor while the crank handle is in the operating position.

11. In an operating mechanism for operating devices through a resilient drive shaft including driven means operably connected to the drive shaft for rotation thereof; driving means; means for locking the driven means while the drive shaft is torsionally stressed; means for moving the driving means to engage the driven means; an improvement for preventing torsional snap back comprising:

means for releasing the means for locking in response to moving the driving means to engage the driven means; and means for delaying said driving means from engaging the driven means until the torsional stress in the drive shaft has been relieved.

12. An improvement, as claimed in claim 11, wherein the driven means includes a gear train connected to the drive shaft connected to the device, the driving means includes a manually operable crank handle; and wherein said means for delaying comprises motion limiting means which prevents the crank handle from engaging the gear train until the crank handle has been rotated through a partial revolution.

* * * * *